US010391776B2

(12) United States Patent
Hayashi et al.

(10) Patent No.: US 10,391,776 B2
(45) Date of Patent: Aug. 27, 2019

(54) LIQUID STORAGE CONTAINER AND PRINTING APPARATUS

(71) Applicant: CANON KABUSHIKI KAISHA, Tokyo (JP)

(72) Inventors: Hiroki Hayashi, Kawasaki (JP); Tsubasa Takaoka, Tokyo (JP); Kazuya Yoshii, Yokohama (JP); Ryo Shimamura, Yokohama (JP); Akira Shiba, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/353,238

(22) Filed: Nov. 16, 2016

(65) Prior Publication Data

US 2017/0151797 A1 Jun. 1, 2017

(30) Foreign Application Priority Data

Nov. 30, 2015 (JP) ..... 2015-234247
Oct. 20, 2016 (JP) ..... 2016-206064

(51) Int. Cl.
*B41J 2/175* (2006.01)

(52) U.S. Cl.
CPC ..... *B41J 2/17513* (2013.01); *B41J 2/17566* (2013.01); *B41J 2002/17576* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,270,206 | B1 | 8/2001 | Shimizu et al. | 347/86 |
| 6,325,500 | B1 | 12/2001 | Kitabatake et al. | 347/86 |
| 6,347,865 | B1 | 2/2002 | Matsumoto et al. | 347/86 |
| 6,382,783 | B1 | 5/2002 | Hayashi et al. | 347/85 |
| 6,402,298 | B1 | 6/2002 | Nanjo et al. | 347/49 |

(Continued)

FOREIGN PATENT DOCUMENTS

| | | |
|---|---|---|
| CN | 201002397 | 1/2008 |
| CN | 101274533 | 10/2008 |

(Continued)

OTHER PUBLICATIONS

U.S. Appl. No. 15/272,026, filed Sep. 21, 2016.

(Continued)

*Primary Examiner* — Anh T Vo
(74) *Attorney, Agent, or Firm* — Venable LLP

(57) ABSTRACT

The liquid storage container of the present invention includes a liquid storage chamber, a support part, and a rocking body configured to rock with the support part as a fulcrum. The rocking body has, on one hand, a float part that moves in accordance with the height of the liquid surface of the liquid within the liquid storage chamber, and on the other hand, a detection target part that is used to detect the amount of the liquid within the liquid storage chamber, and the detection target part is coupled to the supported part via an arm part. The low end in the vertical direction of a connection part at which the arm part and the supported part are connected is located on the lower side in the vertical direction than the top end in the vertical direction of a rotating area of the supported part.

11 Claims, 9 Drawing Sheets

(56) References Cited

U.S. PATENT DOCUMENTS 6,422,674 B1 7/2002 Hinami et al. ..... 347/7
6,443,567 B1 9/2002 Hayashi et al. ..... 347/85
6,447,084 B1 9/2002 Uetsuki et al. ..... 347/7
6,450,631 B1 9/2002 Hayashi et al. ..... 347/86
6,471,343 B1 10/2002 Shimizu et al. ..... 347/85
6,474,797 B2 11/2002 Kurata et al. ..... 347/85
6,485,136 B1 11/2002 Shimizu et al. ..... 347/86
6,505,923 B1 1/2003 Yamamoto et al. ..... 347/85
6,511,167 B1 1/2003 Kitabatake et al. ..... 347/86
6,530,654 B2 3/2003 Kitabatake et al. ..... 347/86
6,540,321 B1 4/2003 Hirano et al. ..... 347/22
6,540,342 B2 4/2003 Koshikawa et al. ..... 347/86
6,543,886 B1 4/2003 Hattori et al. ..... 347/85
6,550,898 B2 4/2003 Hayashi et al. ..... 347/85
6,598,963 B1 7/2003 Yamamoto et al. ..... 347/85
6,629,758 B2 10/2003 Okamoto et al. ..... 347/85
6,637,872 B2 10/2003 Ara et al. ..... 347/85
6,692,115 B2 2/2004 Sanada et al. ..... 347/85
6,698,871 B1 3/2004 Hayashi et al. ..... 347/86
6,709,092 B2 3/2004 Hayashi et al. ..... 347/86
6,719,415 B1 4/2004 Hattori et al. ..... 347/86
6,746,110 B2 6/2004 Hayashi ..... 347/86
6,755,500 B2 6/2004 Hirano et al. ..... 347/22
6,796,645 B2 9/2004 Hayashi et al. ..... 347/86
6,805,434 B2 10/2004 Hayashi et al. ..... 347/85
6,815,381 B1 11/2004 Yamamoto et al. ..... 442/187
6,827,431 B2 12/2004 Kitabatake et al. ..... 347/86
6,851,798 B2 2/2005 Koshikawa et al. ..... 347/85
6,863,762 B2 3/2005 Sanada et al. ..... 156/180
6,877,847 B2 4/2005 Hayashi et al. ..... 347/86
6,942,326 B2 9/2005 Hayashi et al. ..... 347/86
6,966,631 B2 11/2005 Matsuo et al. ..... 347/49
6,997,548 B2 2/2006 Matsuo et al. ..... 347/86
7,118,194 B2 10/2006 Matsuo et al. ..... 347/49
7,134,747 B2 11/2006 Hayashi et al. ..... 347/86
7,165,829 B2 1/2007 Hayashi et al. ..... 347/49
7,350,909 B2 * 4/2008 Takagi ..... B41J 2/17513 347/86
7,357,494 B2 4/2008 Katayama et al. ..... 347/86
8,011,768 B2 9/2011 Hayashi et al. ..... 347/86
8,016,376 B2 * 9/2011 Sugahara ..... B41J 2/17566 347/7
8,042,925 B2 * 10/2011 Sugahara ..... B41J 2/1752 347/86
8,083,308 B2 * 12/2011 Sugahara ..... B41J 2/17566 347/19
8,104,880 B2 1/2012 Sugahara ..... 347/85
8,246,151 B2 * 8/2012 Nakamura ..... B41J 2/17513 347/19
8,393,722 B2 * 3/2013 Sakurai ..... B41J 2/17566 347/86
8,439,491 B2 5/2013 Hayashi et al. ..... 347/86
8,485,642 B2 7/2013 Hayashi et al. ..... 347/49
8,529,035 B2 9/2013 Tsukamoto et al. ..... 347/86
8,529,037 B2 9/2013 Miyashita et al. ..... 347/86
8,672,462 B2 * 3/2014 Nakamura ..... B41J 2/17509 347/50
8,678,573 B2 * 3/2014 Nakamura ..... B41J 2/17526 347/84
8,899,716 B2 * 12/2014 Takagi ..... B41J 2/17503 347/19
8,960,869 B2 2/2015 Takada et al. ..... 347/86
8,960,875 B2 2/2015 Shiba et al. ..... 347/93
9,139,012 B2 9/2015 Yamada et al. ..... B41J 2/17553
9,242,471 B2 1/2016 Yoneda et al. ..... B23P 19/027
9,278,540 B2 3/2016 Seki et al. ..... B41J 2/17513
9,375,938 B2 6/2016 Kondo et al. ..... B41J 2/17513
9,782,974 B2 10/2017 Kanbe et al. ..... B41J 2/17526
2003/0038867 A1 2/2003 Yamamoto et al. ..... 347/86
2007/0139495 A1 * 6/2007 Hattori ..... B41J 2/17513 347/86
2009/0179925 A1 * 7/2009 Sugahara ..... B41J 2/17566 347/7
2009/0179926 A1 * 7/2009 Sugahara ..... B41J 2/17566 347/7
2009/0184991 A1 * 7/2009 Sugahara ..... B41J 2/17566 347/7
2009/0244222 A1 10/2009 Aoyama ..... 347/86
2011/0012953 A1 * 1/2011 Nakamura ..... B41J 2/17513 347/19
2011/0209335 A1 9/2011 Yamamoto et al. ..... 29/505
2011/0234717 A1 * 9/2011 Sakurai ..... B41J 2/17566 347/86
2013/0162732 A1 * 6/2013 Takagi ..... B41J 2/17503 347/86
2014/0034140 A1 2/2014 Dan ..... B41J 2/17506
2014/0055535 A1 * 2/2014 Takagi ..... B41J 2/1752 347/86
2015/0343793 A1 12/2015 Takada et al. ..... B41J 2/17556
2015/0352851 A1 12/2015 Shiba et al. ..... B41J 2/17513
2016/0200113 A1 7/2016 Nanjo et al. ..... B41J 2/175
2016/0200114 A1 7/2016 Nanjo et al. ..... B41J 2/17553

FOREIGN PATENT DOCUMENTS

CN 101547793 9/2009
CN 101549587 10/2009
CN 203004524 6/2013
JP 4595359 B2 12/2010
JP 2014-188773 10/2014

OTHER PUBLICATIONS

U.S. Appl. No. 15/288,879, filed Oct. 7, 2016.
U.S. Appl. No. 15/332,604, filed Oct. 24, 2016.
U.S. Appl. No. 15/338,031, filed Oct. 28, 2016.
U.S. Appl. No. 15/274,806, filed Sep. 23, 2016.
Office Action dated Sep. 29, 2018 in counterpart Chinese Application No. 2016-11070865.0, together with English translation thereof.
Office Action dated Mar. 12, 2019 in counterpart Chinese Application No. 201611070865.0, together with English translation thereof.

* cited by examiner

LIQUID STORAGE CONTAINER AND PRINTING APPARATUS

BACKGROUND OF THE INVENTION

Field of the Invention

The present invention relates to a liquid remaining amount detection mechanism of a liquid storage container and a printing apparatus mounting a liquid storage container having a liquid remaining amount detection mechanism.

Description of the Related Art

An ink jet printing apparatus is known, which prints images, characters, etc., on a printing medium by ejecting a liquid onto the printing medium from a liquid ejection head. It is common for the printing apparatus such as this to mount a liquid storage container that can be attached and detached, or a liquid storage container capable of filling a liquid while being mounted on the printing apparatus. From the viewpoint of user convenience, it is desirable for a user to be capable of grasping the amount of remaining liquid within the liquid storage container in the state where the liquid storage container is attached to the printing apparatus. As a configuration with which it is possible to grasp the amount of remaining liquid within the liquid storage container, the liquid remaining amount detection mechanism described in Japanese Patent No. 4595359 has been proposed.

SUMMARY OF THE INVENTION

An object of the present invention is to cause a rocking body to operate smoothly by suppressing adhesion or fixation of a rotating area in the rocking body, and to make it possible for a printing apparatus to more securely detect the amount of remaining liquid within a liquid storage container. FIG. 1 is a schematic sectional view of the liquid storage container representing the liquid remaining amount detection mechanism described in Japanese Patent No. 4595359. A liquid storage container 1 has a rocking body 10. As the liquid within the liquid storage container is consumed by the printing apparatus, the rocking body 10 is exposed to an atmosphere space A within the liquid storage container 1 in the order of a detection target part 13, an arm part 14, an axis part 11, and a float part 12. At this time, the droplets remaining on the surface of the detection target part 13 flow in the direction of an arrow a along the arm part 14 by the gravitational force.

The liquid storage container of the present invention includes: a liquid storage chamber configured to store a liquid; a support part provided in the liquid storage chamber; and a rocking body having, on one hand, a float part that moves in accordance with the height of a liquid surface of the liquid within the liquid storage chamber via a supported part that is supported rotatably by the support part, and on the other hand, a detection target part that is used to detect the amount of the liquid within the liquid storage chamber, and configured to rock with the support part as a fulcrum, and the detection target part is coupled to the supported part via an arm part and the low end in the vertical direction of a connection part at which the arm part and the supported part are connected is located on the lower side in the vertical direction than the top end in the vertical direction of the rotating area of the supported part.

Further features of the present invention will become apparent from the following description of exemplary embodiments (with reference to the attached drawings).

DESCRIPTION OF THE EMBODIMENTS

The inventors of the present invention have discussed the liquid storage container described in Japanese Patent No. 4595359 and have found that the droplets exposed to the atmosphere tend to become adhesive or fixative and that there is a possibility that the droplets cause adhesion or fixation of the rotating area of the axis part 11 (area of an axis hole 15 to which a pivot 7 is attached). In the case where the droplets left unremoved in the rotating area become adhesive or fixative, there is a possibility that the smooth behavior of the rocking body 10 is impeded.

In the following, an aspect for embodying the present invention is explained with reference to the drawings. However, the components described in these embodiments are merely exemplary and are not intended to limit the scope of the present invention to those.

Figure 1:
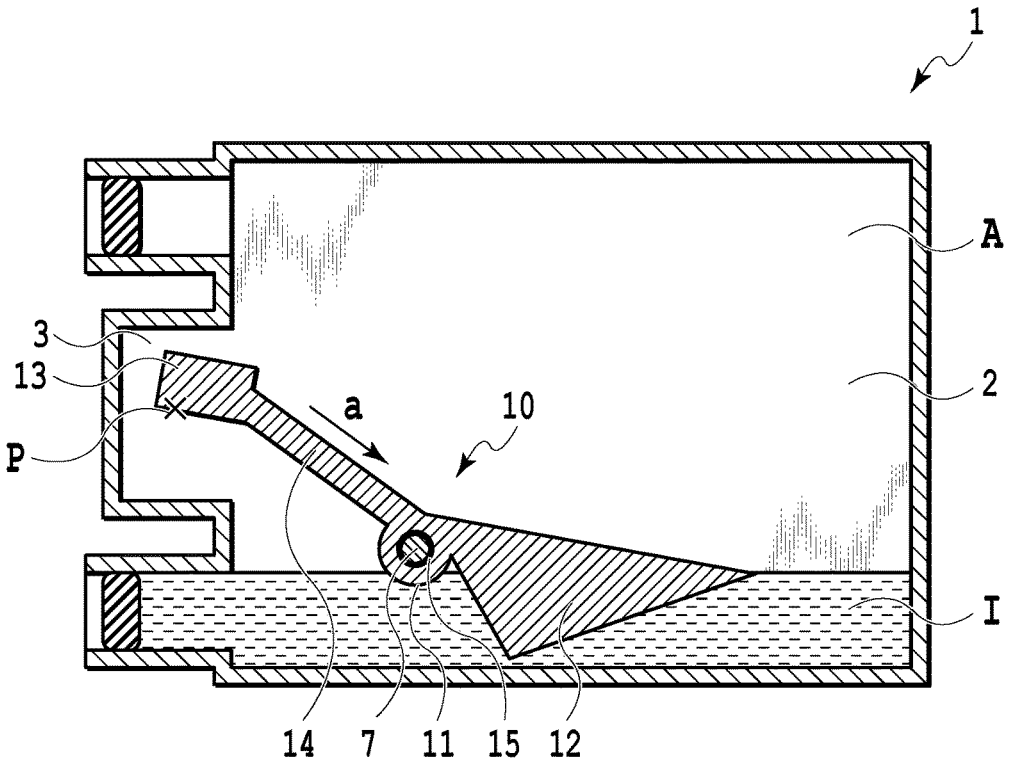
FIG. 1 is a schematic sectional view of a liquid storage container in the prior art.

Before the embodiments are explained, the liquid remaining amount detection mechanism of the prior art is discussed. As shown in FIG. 1, the liquid storage container 1 includes a liquid storage chamber 2 configured to store a liquid I, a detection target chamber 3 communicating with the liquid storage chamber 2, and the rocking body 10 configured to rock in accordance with the amount of the remaining liquid I stored in the liquid storage container 1. The rocking body 10 includes the axis part 11, the float part 12, the detection target part 13, and the arm part 14 that couples the axis part 11 to the detection target part 13. The axis part 11 includes the axis hole 15 that is fit at the outside of the pivot 7 extending from the liquid storage chamber 2 and the rocking body 10 is attached to the liquid storage container 1 so that the float part 12 and the detection target part 13 can rock like a seesaw with the axis part 11 as a center.

In the printing apparatus main body, an optical sensor is provided, which is arranged so that a light-emitting unit and a light-receiving unit sandwich the detection target chamber 3 from the outside of the liquid storage container 1. A reference letter P indicates the detection position of the optical sensor. In the case where the amount of remaining liquid within the liquid storage container 1 is large, the float part 12 ascends within the liquid storage chamber 2 by the buoyant force and the detection target part 13 provided on the opposite side of the float part 12 descends in the detection target chamber 3 with the axis part 11 as a center. At this time, the detection target part 13 is eventually located on the lower side within the detection target chamber, and therefore, the light rays output from the optical sensor are shut off by the detection target part 13. The printing apparatus reports a user that the amount of remaining liquid within the liquid storage container 1 is large via a display or the like provided in the recording apparatus based on that the light rays output from the optical sensor are in the shut-off state.

As the amount of remaining liquid within the liquid storage container 1 becomes small and the height of the liquid surface is reduced from the upper side in the vertical direction to the lower side in the vertical direction, the rocking body 10 is exposed from the liquid I to the atmosphere space A. The float part 12 descends within the liquid storage chamber 2 by the gravitational force and on the contrary, the detection target part 13 ascends within the detection target chamber 3. At this time, the detection target part 13 is eventually located on the upper side within the detection target chamber, and therefore, the light rays output from the optical sensor begin to pass through the detection target chamber 3. The printing apparatus reports a user that the amount of remaining liquid within the liquid storage container 1 becomes small via a display or the like provided in the printing apparatus based on that the light rays output from the optical sensor are in the transmission state.

In the case where the detection target part 13 is located on the upper side of the detection target chamber 3, the droplets remaining on the surface of the detection target part 13 flow in the direction of the arrow a along the arm part 14 by the gravitational force. The droplets exposed to the atmosphere tend to become adhesive or fixative, and therefore, there is a possibility that adhesion or fixation of the rotating area of the axis part 11 (area of the axis hole 15 to which the pivot 7 is attached) is caused. In the case where the droplets left unremoved become adhesive or fixative, there is a possibility that the smooth behavior of the rocking body 10 is impeded. In the case where the smooth behavior of the rocking body 10 is impeded, there is a possibility that the detection precision of the optical sensor is degraded and it is no longer possible to securely detect the amount of remaining liquid within the liquid storage container.

First Embodiment

Figure 2:
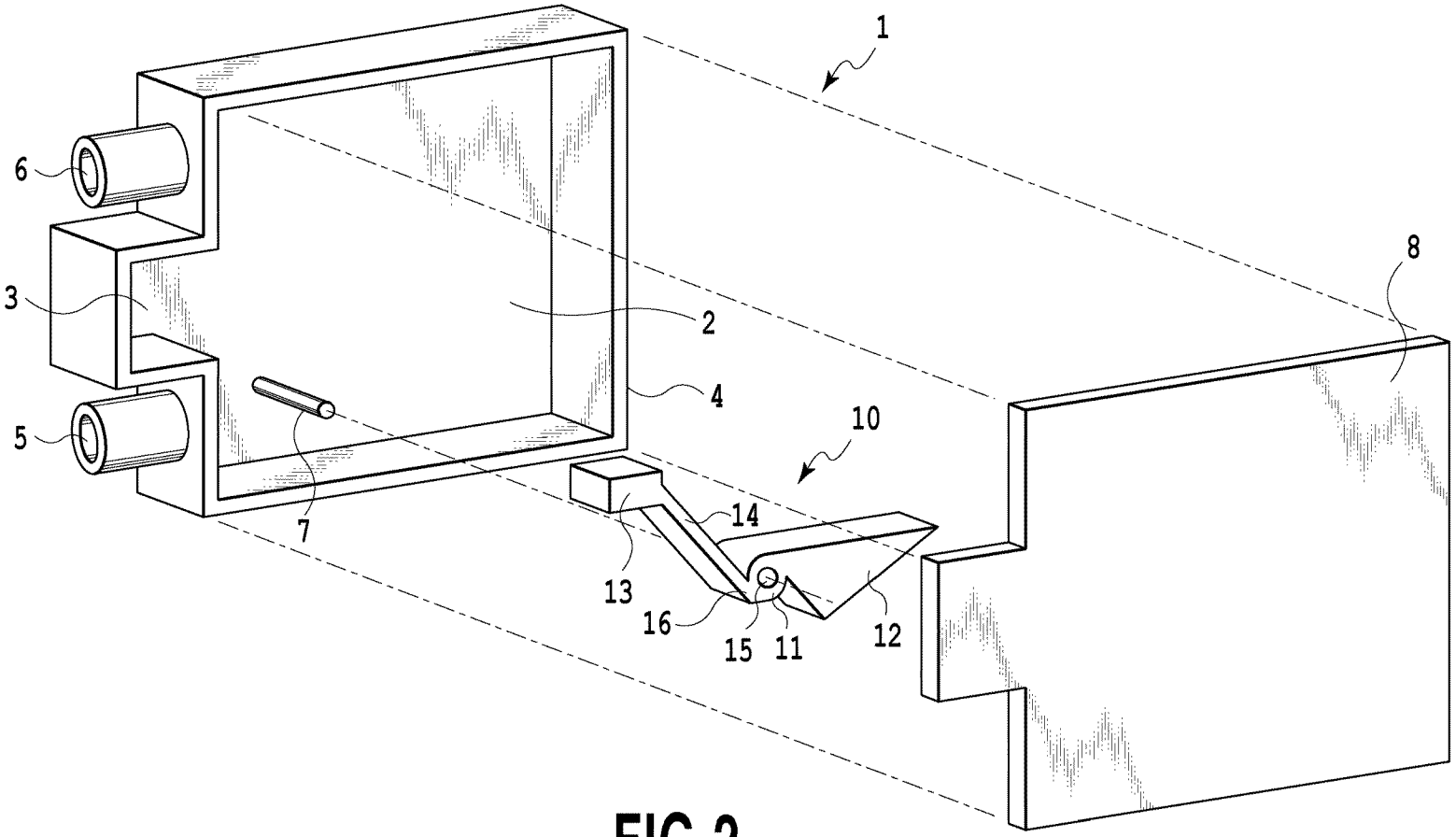
FIG. 2 is an exploded perspective view of a liquid storage container in a first embodiment.
Figure 3:
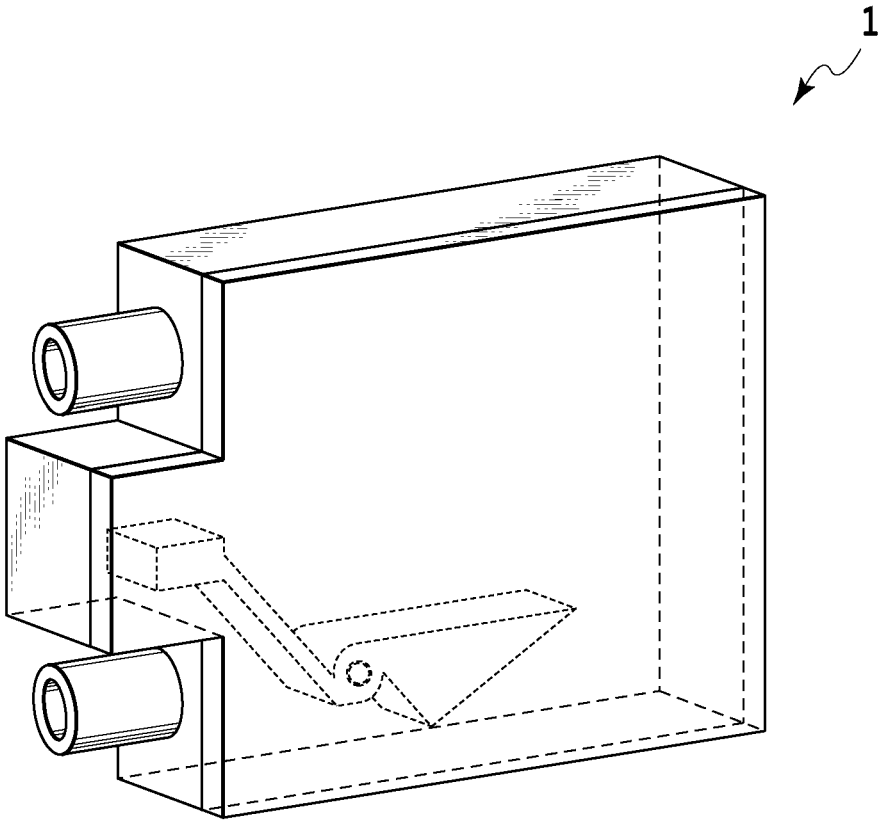
FIG. 3 is a perspective view of the liquid storage container after assembly in the first embodiment.

FIG. 2 is an exploded perspective view of the liquid storage container 1 in the present embodiment and FIG. 3 is a perspective view of the liquid storage container 1 after assembly.

The liquid storage container 1 of the present embodiment includes a container casing 4 the side surface of which is open and a container lid 8 that covers the side surface opening of the container casing 4. For the assembly of the container casing 4 and the container lid 8, it is possible to use, for example, the method of ultrasonic welding so as to prevent a liquid stored in the liquid storage container 1 from leaking out, but the assembly method is not limited to this. The container casing 4 includes the liquid storage chamber 2 configured to store a liquid, a liquid supply port 5 through which the liquid stored in the liquid storage chamber 2 is supplied to the printing apparatus main body, and an atmosphere introduction port 6 through which the atmosphere is introduced into the liquid storage container 1. The liquid supply port 5 and the atmosphere introduction port 6 are sealed with a sealing member, to be described later, in order to prevent the liquid stored within the liquid storage container 1 from leaking out during the transport of the liquid storage container 1. By a liquid supply pipe 17 in the shape of a pipe (not shown schematically in FIG. 1) provided to the printing apparatus being attached to the liquid supply port 5, it is made possible to supply the liquid stored within the liquid storage container 1 to the printing apparatus main body. Similarly, by an atmosphere introduction pipe in the shape of a pipe (not shown schematically in FIG. 1) provided to the printing apparatus being attached to the atmosphere introduction port 6, it is made possible to introduce the outside atmosphere into the liquid storage container 1.

The container casing 4 is provided with the liquid storage chamber 2 and the detection target chamber 3 communicating with the liquid storage chamber 2, and the liquid storage chamber 2 and the detection target chamber 3 are arranged so that the liquid within the liquid storage container 1 can be distributed to each other. Further, the liquid storage chamber 2 is provided with the pivot 7, which is a support part, and the axis part 11 of the rocking body 10, which is a supported part, is supported rotatably.

The rocking body 10 that is used to detect the liquid surface of the liquid storage container 1 rocks in accordance with the amount of remaining liquid stored in the liquid storage container 1. The rocking body 10 of the present embodiment has, on one hand, the float part 12 that moves in accordance with the height of the liquid surface within the liquid storage chamber via the axis part 11, and on the other hand, the detection target part 13 that is used to detect the amount of liquid within the liquid storage chamber. Further, the rocking body 10 is supported so as to be capable of rocking like a seesaw within the liquid storage container 1 with the axis part 11 as a fulcrum, and the detection target part 13 is coupled to the axis part 11 via the arm part 14.

In the present embodiment, in order to cause the rocking body 10 to rock smoothly, a predetermined clearance is provided between the pivot 7 and the axis hole 15. In the case where the clearance is too large, the position of the rocking body 10 within the liquid storage container 1 is not stabilized, and therefore, the detection precision of the optical sensor, to be described later, is degraded. On the contrary, in the case where the clearance is too small, frictional resistance occurs at the time of rotation of the pivot 7 and the axis hole 15, and therefore, the operation of the rocking body 10 within the liquid storage container 1 becomes unstable. Because of this, it is favorable for the clearance between the pivot 7 and the axis hole 15 in the present embodiment to be about 0.2 mm (not less than 0.1 mm and not more than 0.3 mm).

As the material of the liquid storage container 1 and the rocking body 10 in the present embodiment, a PP (polypropylene) resin is used favorably. Of course, the material of the liquid storage container 1 and the rocking body 10 is not limited to the PP resin and another material, such as a PE (polyethylene) resin, or a metal may be used. Further, the mechanism to cause the rocking body 10 to rock is not limited to the structure in which the container casing 4 is provided with the pivot 7 and the rocking body 10 is provided with the axis hole 15, and it is only required for the rocking body 10 to be attached so as to be capable of rocking within the liquid storage container 1. For example, it may also be possible to configure the pivot 7 as a part separate from the container casing 4. Alternatively, a structure may be accepted in which the container casing 4 is provided with a bearing and the axis part 11 of the rocking body 10 is provided with a pivot, respectively.

Figure 4:
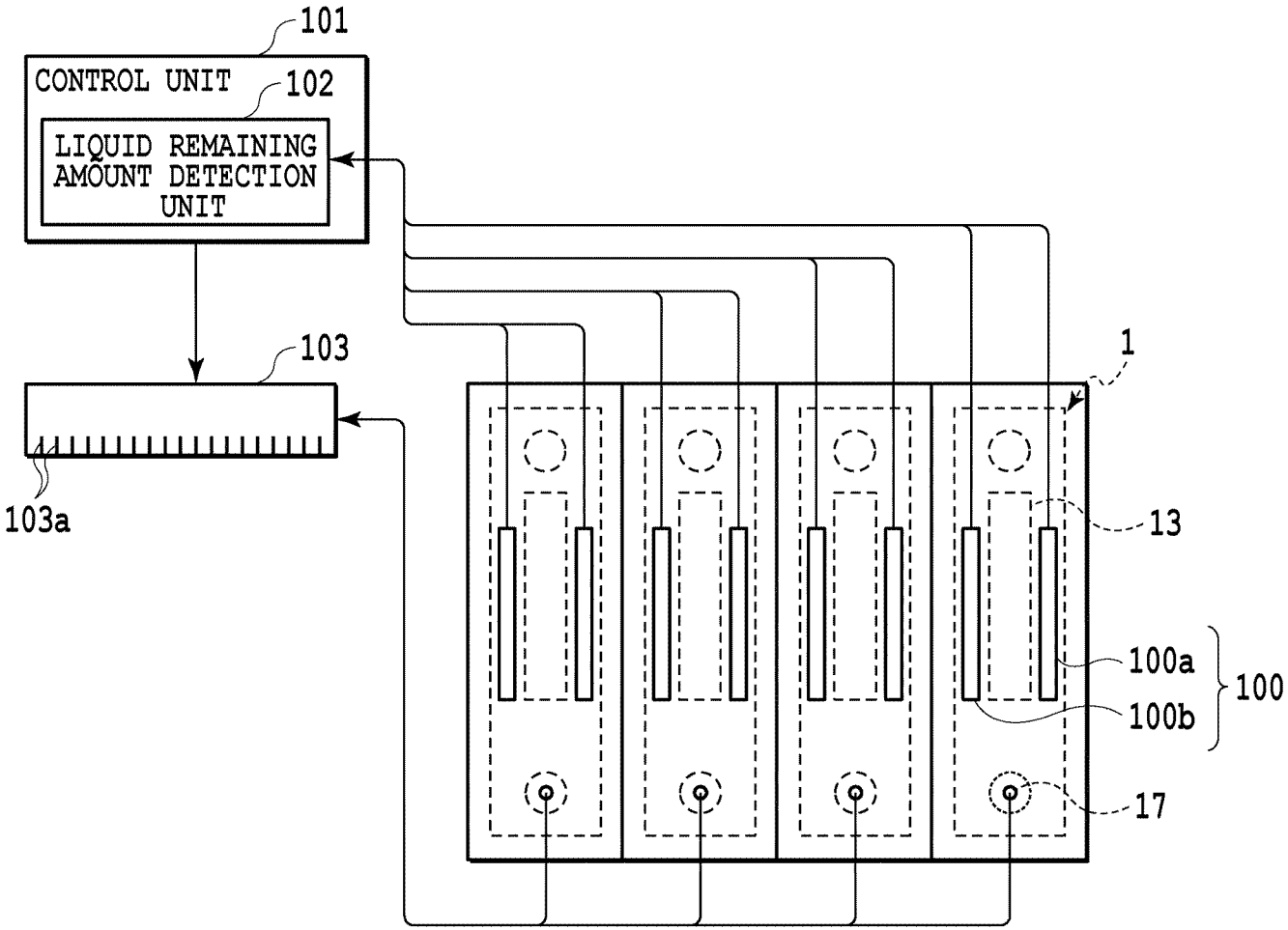
FIG. 4 is a function block diagram of a liquid remaining amount detection mechanism in the first embodiment.

FIG. 4 is a function block diagram of the liquid remaining amount detection mechanism in the present embodiment. In the following, with reference to FIG. 4, a method of detecting the amount of remaining liquid within the liquid storage container 1 is explained.

FIG. 4 shows part of the liquid storage container 1 in the front view in the case where the surface on which the liquid supply pipe 17 is inserted into the liquid supply port 5 is viewed from the outside. In the present embodiment, the four liquid storage containers 1 corresponding to the four kinds of liquid (cyan, magenta, yellow, black) are shown, but the kinds of liquid and the number of corresponding liquid storage containers 1 are not limited to those of the present embodiment. The liquid supply pipe 17 is caused to communicate with a liquid ejection head 103, which is a print head of the printing apparatus main body, and is configured so as to be capable of supplying a liquid from the liquid storage container 1. Upon receipt of a control signal for forming an image from a control unit 101 of the printing apparatus main body, the liquid ejection head 103 ejects a liquid via an ejection port 103*a* and performs a printing operation to form an image on a printing medium.

On the other hand, the printing apparatus has an optical sensor 100 that is arranged in the vicinity of the liquid storage container 1, and an electric signal from the optical sensor 100 is configured so as to be capable of being output to the control unit 101. In the present embodiment, a light-emitting unit 100*a* and a light-receiving unit 100*b* are arranged so as to sandwich the detection target chamber 3 from the outside, and it is possible for the light-emitting unit 100*a* to output light rays to the light-receiving unit 100*b*. In the case where the light-receiving unit 100*b* receives light rays, the optical sensor 100 outputs a signal indicating that the detection target chamber 3 of the liquid storage container 1 is in the transmission state to the control unit 101. On the other hand, in the case where light rays are shut off by the detection target part 13 and it is not possible for the light-receiving unit 100*b* to receive light rays, the optical sensor 100 suspends outputting of a signal to the control unit 101.

A liquid remaining amount detection unit 102 detects the amount of remaining liquid within the liquid storage container 1 based on the presence/absence of a signal that is received from the optical sensor 100. As in the liquid remaining amount detection mechanism of the prior art, as the liquid surface within the liquid storage container 1 lowers and the float part 12 descends within the liquid storage chamber 2, the detection target part 13 ascends within the liquid storage container 1. Next, the light rays having been shut off by the detection target part 13 begin to be received by the light-receiving unit 100*b*. Then, the optical sensor 100 outputs a signal indicating that the shut-off state has changed into the transmission state to the control unit 101.

In the case of determining that the signal from the optical sensor 100 has been received, the liquid remaining amount detection unit 102 detects that the amount of remaining liquid within the liquid storage container 1 becomes small. In the present embodiment, in the case where it is detected that the amount of remaining liquid within the liquid storage container 1 becomes small, the control unit 101 displays a message prompting the exchange of the liquid storage container 1 with a new one on the display provided in the printing apparatus.

Figure 5A:
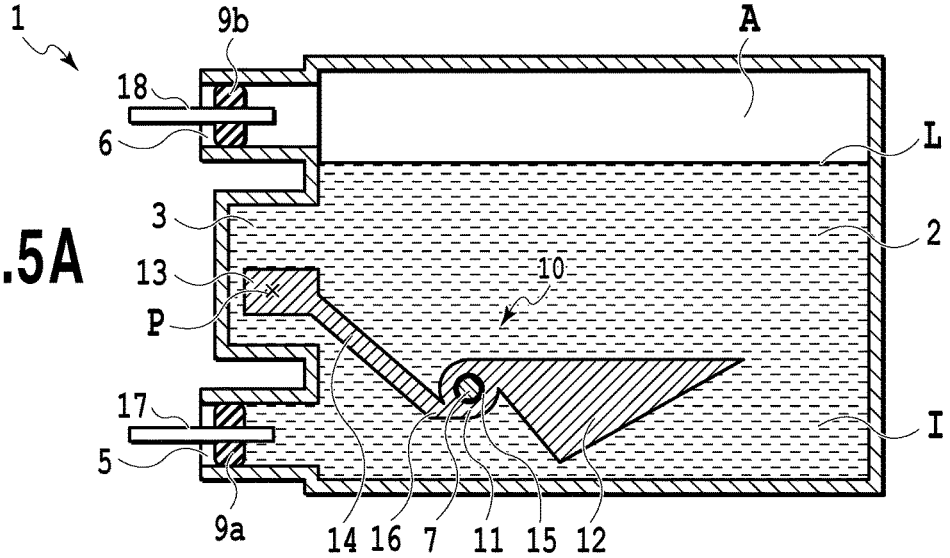
FIG. 5A to FIG. 5C are diagrams showing details of the liquid remaining amount detection mechanism in the first embodiment.
Figure 5B:
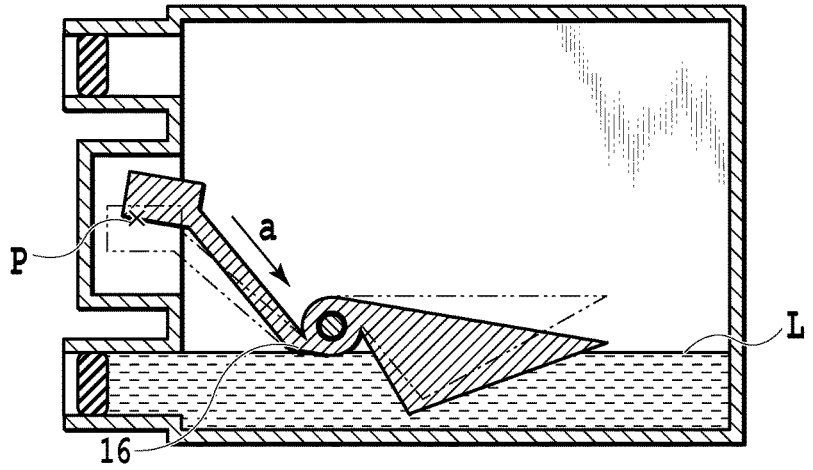
Figure 5C:
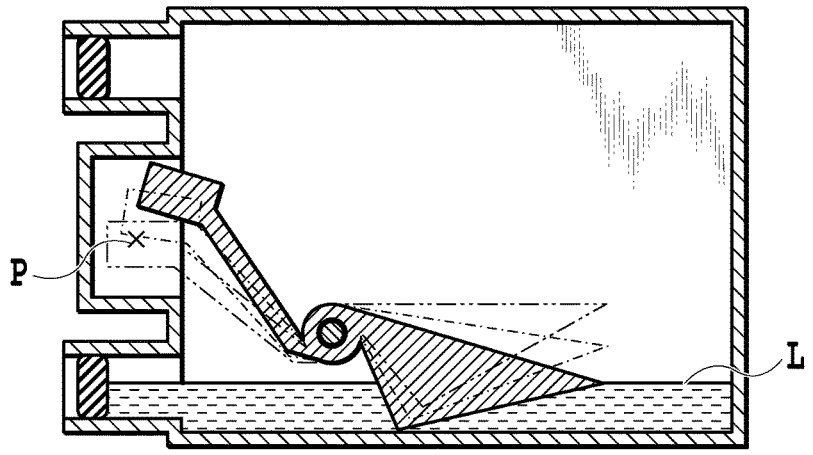

FIG. 5A to FIG. 5C are diagrams showing details of the liquid remaining amount detection mechanism in the present embodiment. In the following, with reference to FIG. 5A to FIG. 5C, the liquid remaining amount detection mechanism of the present embodiment is explained in detail.

The printing apparatus main body is provided with the optical sensor 100 that is arranged so as to sandwich the detection target chamber 3 by the light-emitting unit 100*a* and the light-receiving unit 100*b* shown in FIG. 4 from the outside of the liquid storage container 1. A reference letter P indicates the detection position of the optical sensor. In the case where the amount of remaining liquid within the liquid storage container 1 is large, the float part 12 ascends in the liquid I by the buoyant force and the detection target part 13 provided on the opposite side of the float part 12 with the axis part 11 as a center descends in the liquid I. At this time, the detection target part 13 is eventually located on the lower side of the detection target chamber 3, and therefore, the light rays output from the optical sensor are shut off by the detection target part 13. It is possible for the printing apparatus to detect that the amount of remaining liquid within the liquid storage container 1 is large based on that the light rays output from the optical sensor are in the shut-off state.

As the amount of remaining liquid within the liquid storage container 1 becomes small and the height of a liquid surface L is reduced, the rocking body 10 is exposed to the atmosphere space A from the liquid I. The float part 12 descends in the liquid by the gravitational force and on the contrary, the detection target part 13 ascends within the detection target chamber 3. In the case where the height of the liquid surface L is reduced and most of the rocking body 10 is exposed to the atmosphere space A from the liquid I, the detection target part 13 is eventually located on the upper side of the detection target chamber 3, and therefore, the light rays output from the optical sensor begin to pass through the detection target chamber 3. It is possible for the printing apparatus to detect that the amount of remaining liquid within the liquid storage container 1 becomes small based on that the light rays output from the optical sensor are in the transmission state.

As described previously, the liquid storage container 1 is provided with the liquid supply port 5 through which the liquid stored in the liquid storage chamber 2 is supplied to the printing apparatus main body, and the atmosphere introduction port 6 through which the atmosphere is introduced into the liquid storage container 1. The liquid supply port 5 and the atmosphere introduction port 6 are sealed with a sealing member 9 in order to prevent the liquid stored inside the liquid storage container 1 from leaking out during the transport of the liquid storage container 1. The sealing member 9 of the present embodiment is made up of, for example, an elastic member, such as rubber.

In the case where the liquid storage container 1 is mounted on the printing apparatus (FIG. 5A), by the liquid supply pipe 17, which is provided to the printing apparatus main body, penetrating through a sealing member 9*a* of the liquid supply port 5, it is made possible to supply the liquid within the liquid storage chamber 2 to the printing apparatus. Similarly, in the case where the liquid storage container 1 is mounted on the printing apparatus, by the atmosphere introduction port 18, which is provided to the printing apparatus main body, penetrating through a sealing member 9*b* of the atmosphere introduction port 6, it is made possible to introduce the atmosphere into the liquid storage container 1.

Next, the operation of the rocking body 10, which is the essential unit of the present embodiment, is explained in detail. FIG. 5A shows a sectional view of the liquid storage container 1 before the printing apparatus consumes the liquid. The rocking body 10 is formed so as to establish a relationship of buoyant force applied to the detection target part 13<buoyant force applied to the float part 12, and gravitational force applied to the float part 12<buoyant force applied to the float part 12 in the liquid I in the liquid storage container 1. Due to the shape such as this of the rocking body 10, in the case where the rocking body 10 is immersed in the liquid I, the force that causes the float part 12 to ascend occurs.

As described previously, the detection target part 13 and the float part 12 rock like a seesaw with the axis part 11 as a fulcrum. Because of this, in the case where the rocking body 10 is immersed in the liquid I, the force that causes the detection target part 13 to descend occurs. The detection target part 13 having descended to the lower side of the detection target chamber 3 shuts off the light rays output from the light-emitting unit 100*a*.

As the printing apparatus consumes the liquid I in the liquid storage container 1, the liquid is supplied to the printing apparatus via the liquid supply port 5 and the atmosphere is introduced into the liquid storage container 1 via the atmosphere introduction port 6. In the case where the liquid surface L comes near to the float part 12, the volume of the float part 12 existing in the atmosphere space A gradually increases and the volume of the float part 12 existing in the liquid I gradually decreases. In this manner, as the liquid surface L descends, the buoyant force applied to the float part 12 gradually diminishes, and therefore, the float part 12 descends to the lower side of the liquid storage chamber 2. In the case where the float part 12 moves to the lower side of the liquid storage chamber 2, the detection target part 13 moves to the upper side of the detection target chamber 3 on the contrary.

FIG. 5B shows a sectional view of the liquid storage container 1 in the state where the position of the float part 12 is descending. The broken line part indicates the initial position of the rocking body 10 (FIG. 5A). In accordance with the descent of the liquid surface L, the float part 12 has descended from the initial position and on the contrary, the detection target part 13 has ascended from the initial position. In the state in FIG. 5B, the amount of movement of the detection target part 13 is not sufficient and the light rays of the optical sensor provided in the printing apparatus main body are still shut off by the detection target part 13. In other words, in the state in FIG. 5B, it is determined that the amount of remaining liquid within the liquid storage container 1 is large.

FIG. 5C shows a sectional view of the liquid storage container 1 in the state where the position of the float part 12 is further descending. The broken line parts indicate the positions of the rocking body 10 in FIG. 5A and FIG. 5B, respectively. In accordance with the further descent of the liquid surface L, the float part 12 has descended from the position in FIG. 5B and on the contrary, the detection target part 13 has ascended from the position in FIG. 5B. In the state in FIG. 5C, the light rays of the optical sensor provided in the printing apparatus main body are not shut off by the detection target part 13. In other words, in the state in FIG. 5C, it is determined that the amount of remaining liquid within the liquid storage container 1 is small.

Figure 6:
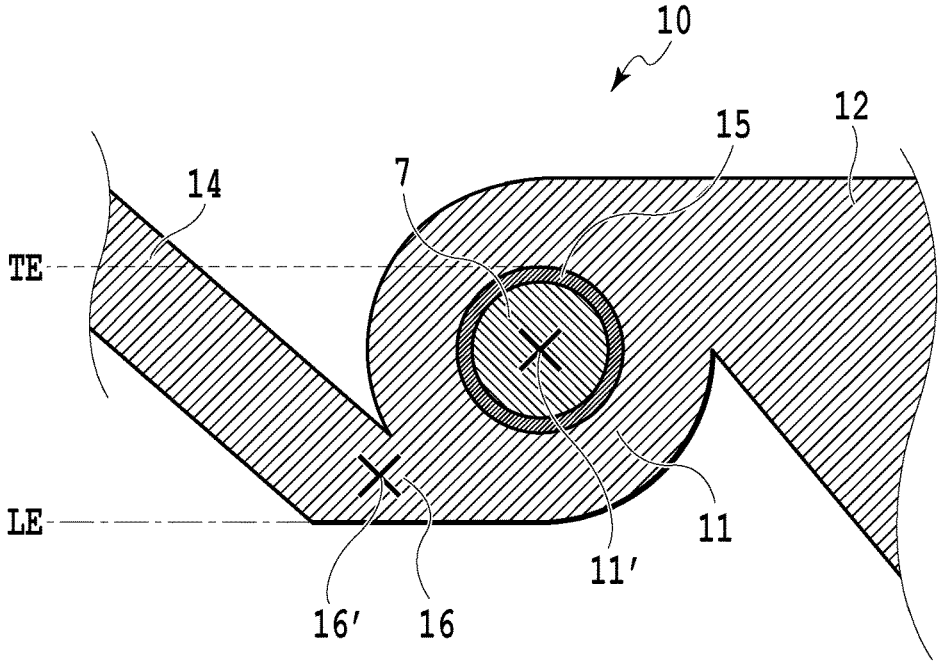
FIG. 6 is an enlarged view showing a position relationship in the vicinity of a rotating area in the first embodiment.

FIG. 6 is an enlarged view showing a position relationship in the vicinity of the rotating area of the rocking body 10. As shown in FIG. 6, in the rocking body 10 of the present embodiment, a low end LE in the vertical direction of a connection part 16 between the axis part 11 and the arm part 14 is located on the lower side in the vertical direction than a top end TE in the vertical direction of the rotating area of the supported part (axis part 11). Due to the configuration such as this, even in the case where the liquid storage container 1 is left in the state (state in FIG. 5B) where it is determined that the amount of remaining liquid is large despite that the liquid I is consumed, it is possible to suppress the adhesion or fixation of the rotating area (area of the axis hole 15 to which the pivot 7 is attached) at the axis part 11. That is, even in the case where the droplets remaining on the surface of the rocking body 10 flow in the direction of the arrow a in FIG. 5B along the arm part 14, the droplets tend to flow on the lower side of the axis part 11, and therefore, it is possible to suppress the adhesion or fixation of the rotating area at the axis part 11. As a result of this, it is possible to cause the rocking body 10 to operate smoothly and for the printing apparatus to securely detect the amount of remaining liquid within the liquid storage container 1. It is preferable for the low end LE in the vertical direction of the connection part 16 to be located on the lower side in the vertical direction than a center 11' in the vertical direction of the rotating area of the supported part. Further, it is preferable for a center 16' in the vertical direction of the connection part 16 to be located on the lower side in the vertical direction than the top end TE in the vertical direction of the rotating area of the supported part. Furthermore, it is preferable for the center 16' in the vertical direction of the connection part 16 to be located on the lower side in the vertical direction than the center 11' in the vertical direction of the rotating area of the supported part. The connection part 16 is apart at which the arm part 14 and the supported part (axis part 11) are connected. In the case where the arm part is linear and the supported part is circular, the connection part 16 is a part at which the straight line and the circle come into contact. Further, in the case such as this, the low end LE in the vertical direction of the connection part 16 is a point at which the straight line and the curve (part of the circumference of the supported part) intersect. There is a case where the low end LE in the vertical direction of the connection part 16 is a point at which the slope changes on the way from the arm part 14 to the supported part.

In FIG. 5A to FIG. 5C and FIG. 6, the example is shown in which the connection part 16 between the axis part 11 and the arm part 14 is located on the lower side in the vertical direction than the axis hole 15, but in the case where it is possible to guide at least part of the droplets remaining on the rocking body 10 to the side lower than the axis hole 15, the connection part 16 may be at another position. Specifically, by the connection part 16 between the axis part 11 and the arm part 14 being located on the lower side in the vertical direction than at least the top end of the axis hole 15, which is the rotating area, it is possible to guide at least part of the droplets remaining on the rocking body 10 to the side lower than the axis hole 15. With this configuration also, it is possible to suppress the adhesion or fixation of the rotating area at the axis part 11. Further, in the case of a structure in which the container casing 4 is provided with a bearing and the axis part 11 of the rocking body 10 is provided with a pivot, the same effect as that in the above-described embodiment is obtained by causing the connection part 16 between the axis part 11 and the arm part 14 to be located on the lower side in the vertical direction than at least the top end of the bearing.

Figure 7:
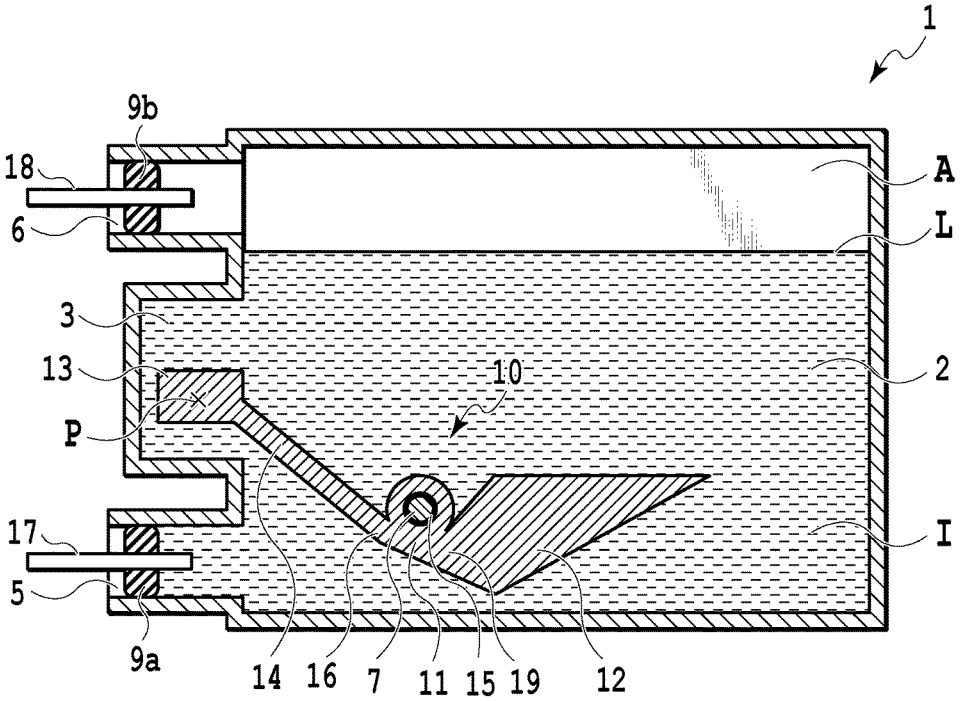
FIG. 7 is a schematic sectional view of a liquid storage container in a modified example of the first embodiment.

FIG. 7 is a schematic sectional view of the liquid storage container 1 in a modified example of the present embodiment.

The configuration differs from the configuration in the above-described embodiment in that not only the connection part 16 between the axis part 11 and the arm part 14 but also a connection part 19 between the axis part 11 and the float part 12 is located on the lower side in the vertical direction than the rotating area of the axis part 11. Due to the configuration such as this, even in the case where the droplets remaining on the surface of the float part 12 flow in the direction toward the axis part 11 of the rocking body 10, the droplets tend to flow on the side lower than the axis hole 15, and therefore, it is possible to suppress the adhesion or fixation of the rotating area of the axis part 11.

Figure 8:
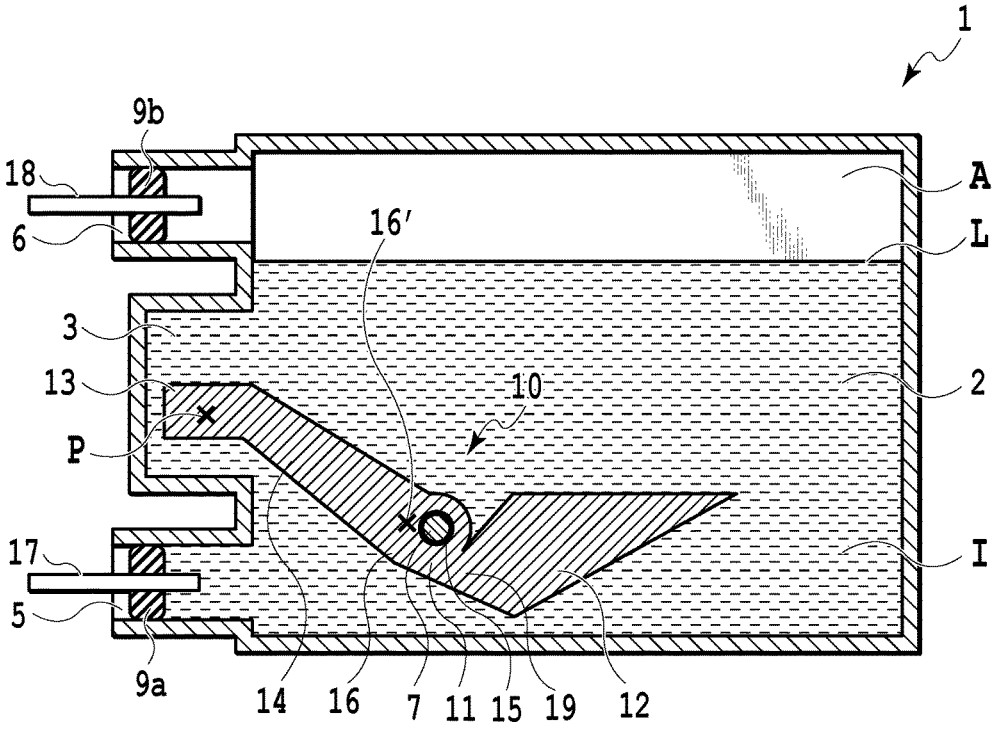
FIG. 8 is a schematic sectional view of a liquid storage container in another modified example of the first embodiment.

FIG. 8 is a schematic sectional view of the liquid storage container 1 in another modified example of the present embodiment.

As a modified example of the above-described embodiment, a configuration as in FIG. 8 is further considered. FIG. 8 is an example in which the thickness of the arm part is increased from that in FIG. 7. In FIG. 8, for example, the center 16' in the vertical direction of the connection part 16 between the axis part 11 and the arm part 14 is located on the upper side in the vertical direction than the center in the vertical direction of the rotating area of the supported part (axis part 11). However, the low end in the vertical direction of the connection part 16 between the axis part 11 and the arm part 14 is located on the lower side in the vertical direction than the top end in the vertical direction of the rotating area of the supported part (axis part 11). The liquid tends to flow through the low end of the arm part, and therefore, even with the configuration such as this, the same effect as that of the above-described embodiment is obtained.

Second Embodiment

Figure 9A:
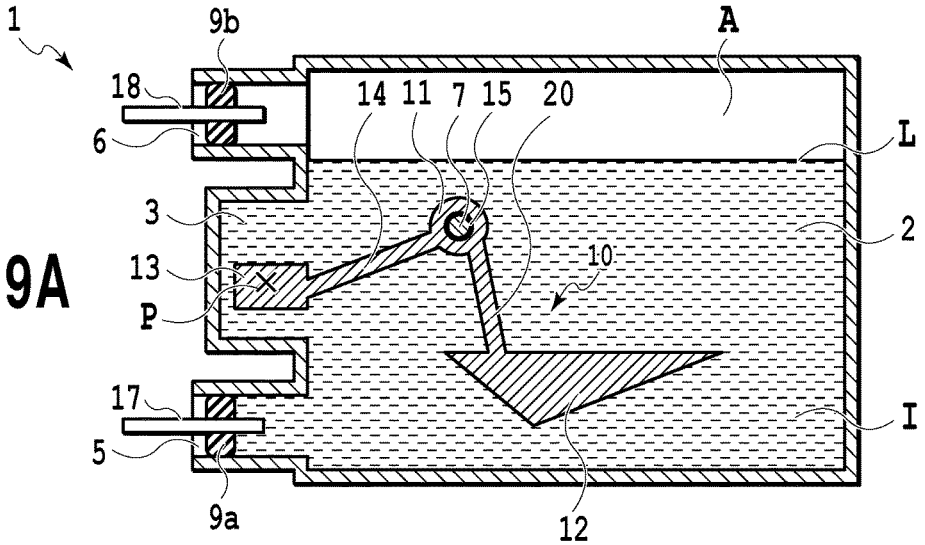
FIG. 9A to FIG. 9C are diagrams showing details of a liquid remaining amount detection mechanism in a second embodiment.
Figure 9B:
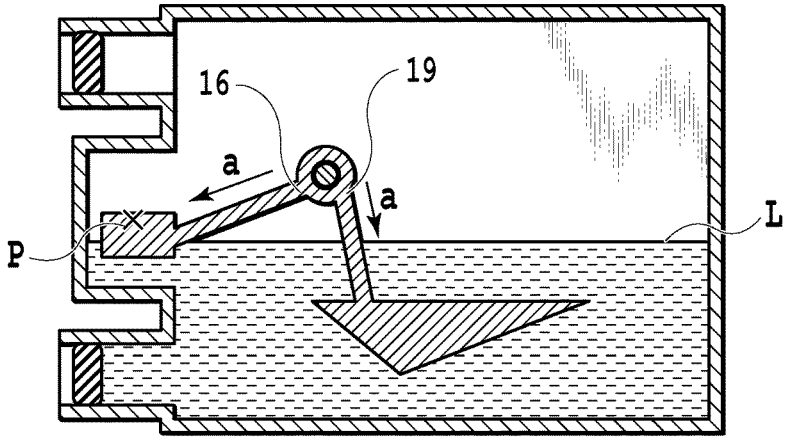
Figure 9C:
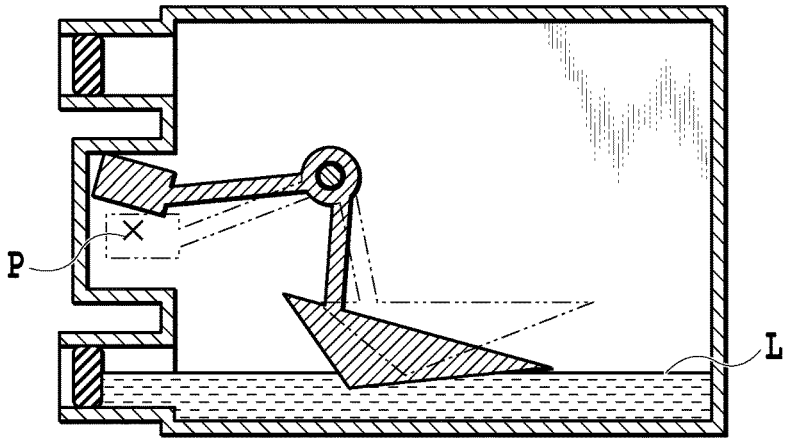

FIG. 9A to FIG. 9C are diagrams showing details of a liquid remaining amount detection mechanism in the present embodiment. In the following, with reference to FIG. 9A to FIG. 9C, the liquid remaining amount detection mechanism of the present embodiment is explained in detail. In explanation of the present embodiment, the same symbols are attached to the same configurations as those of the first embodiment and explanation of duplicated contents is omitted.

FIG. 9A is a schematic sectional view of the liquid storage container 1 in the state before the liquid I is consumed by the printing apparatus. As shown in FIG. 9A, the detection target part 13 of the present embodiment is coupled to the axis part 11 via the arm part 14 and similarly, the float part 12 is coupled to the axis part 11 via an arm part 20. In the rocking body 10 of the present embodiment, the axis part 11 of the rocking body 10 is located on the upper side in the vertical direction than the top end of the float part 12 and the top end of the detection target part 13, and the arm parts 14 and 20 couple the detection target part 13 and the float part 12 to the lower sides in the vertical direction, respectively, from the axis part 11.

FIG. 9B shows a sectional view of the liquid storage container 1 in the state where the liquid I is consumed by the printing apparatus and the height of the liquid surface is reduced. In the present embodiment, in accordance with the descent of the liquid surface L, the rocking body 10 is exposed to the atmosphere space A in the order from the axis part 11 located at the highest level. With the configuration such as this, the droplets remaining on the surface of the axis part 11 flow down in the direction of an arrow a in FIG. 9B along the arm parts 14, 20. Because of this, it is possible to quickly guide the droplets remaining on the surface of the axis part 11 to the lower side, and therefore, it is possible to suppress the adhesion or fixation of the rotating area of the axis part 11.

Other Embodiments

In the above-described embodiments, the aspect is explained in which the container casing 4 and the container lid 8 are assembled by using ultrasonic welding, but it may also be possible to assembly the liquid storage container 1 by another method, such as vibration welding and adhesion.

Further, it may also be possible to form the liquid storage chamber 2 by thermally welding a film to the container casing 4 in place of the container lid 8 and, a configuration may be accepted in which the container casing 4 is formed into the shape of a frame and openings on both sides in the formed frame are covered with a film. In this case, it is preferable for a cover part for protection to be attached to the outside of the container casing 4 in order to prevent damage to the film.

Furthermore, in the above-described embodiments, the aspect is explained in which by the liquid supply pipe 17 being inserted into the sealing member 9 made up of an elastic member, such as rubber, it is made possible to supply the liquid from the liquid storage container 1 to the printing apparatus main body. However, in other embodiments, it may also be possible to implement the liquid supply mechanism by another configuration and an aspect may be accepted in which it is made possible to supply the liquid from the liquid storage container 1 to the printing apparatus main body by pressing the valve against the sealing member 9 by using, for example, an elastic material, such as rubber.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the liquid storage container of the present invention, by suppressing the adhesion or fixation of the rotating area of the rocking body, it is possible to cause the rocking body to operate smoothly. Because of this, it is possible for the printing apparatus to more securely detect the amount of remaining liquid within the liquid storage container.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-234247 filed Nov. 30, 2015, and No. 2016-206064 filed Oct. 20, 2016, which are hereby incorporated by reference wherein in their entirety.

What is claimed is:

1. A liquid storage container comprising:

a liquid storage chamber configured to store a liquid;

a support part provided in the liquid storage chamber; and a rocking body having, on one hand, a float part that moves in accordance with a height of a liquid surface of the liquid within the liquid storage chamber via a supported part that is supported rotatably by the support part, and on the other hand, a detection target part that is used to detect an amount of the liquid within the liquid storage chamber, and configured to rock with the support part as a fulcrum, wherein the detection target part is coupled to the supported part via an arm part, and wherein the arm part extending from the detection target part and an another arm part extending from the float part both extend to a lower side in the vertical direction from the supported part.

2. The liquid storage container according to claim 1, further comprising:

a detection target chamber communicating with the liquid storage chamber, wherein the liquid storage chamber and the detection target chamber are arranged so that the liquid within the liquid storage container can be distributed to each other, and as the float part moves within the liquid storage chamber, the detection target part moves within the detection target chamber.

3. The liquid storage container according to claim 2, wherein the detection target part moves between a first position at which light rays output from an optical sensor arranged outside the detection target chamber are shut off and a second position at which the light rays are transmitted as the float part moves within the liquid storage chamber.

4. The liquid storage container according to claim 1, wherein the support part is a pivot, and the supported part is an axis part having an axis hole attached to the pivot.

5. The liquid storage container according to claim 1, wherein the support part is a bearing, and the supported part is an axis part having a pivot attached to the bearing.

6. The liquid storage container according to claim 1, wherein a low end in the vertical direction of the supported part is located on an upper side in the vertical direction than a top end in the vertical direction of the detection target part and a top end in the vertical direction of the float part.

7. The liquid storage container according to claim 1, wherein the arm part extending from the detection target part is linear, the support part is circular, and the connection part at which the arm part and the supported part come into contact is a part at which the linear and the circular come into contact.

8. The liquid storage container according to claim 1, wherein a low end in the vertical direction of the connection part at which the arm part and the supported part come into contact is a point at which a slope of an outer edge of the rocking body changes on the way from the arm part to the supported part.

9. The liquid storage container according to claim 1, wherein a connection part at which the arm part extending from the detection target part comes into contact with the supported part is at all points lower in a vertical direction than the center in the vertical direction of a rotating area of the supported part.

10. The liquid storage container according to claim 1, wherein in any posture that the rocking body is rocking, the connection part at which the arm part extending from the detection target part and the supported part come into contact is at all points lower in the vertical direction than the center in the vertical direction of the rotating area of the supported part.

11. A printing apparatus comprising:

a print head that performs a printing operation by ejecting a liquid;

a liquid storage container including:

a liquid storage chamber configured to store the liquid;

a support part provided in the liquid storage chamber; and a rocking body having, on one hand, a float part that moves in accordance with a height of a liquid surface of the liquid within the liquid storage chamber via a supported part that is supported rotatably by the support part, and on the other, a detection target part that is used to detect an amount of the liquid within the liquid storage chamber, and configured to rock with the support part as a fulcrum, the liquid storage container being configured to store the liquid to be supplied to the print head, wherein the detection target part is coupled to the supported part via an arm part, and wherein the another arm part extending from the detection target part and an arm part extending from the float part both extend to a lower side in the vertical direction from the supported part, and wherein a control unit is configured to control a printing operation of the print head.

* * * * *